US007854268B2

(12) United States Patent
Lehr et al.

(10) Patent No.: US 7,854,268 B2
(45) Date of Patent: Dec. 21, 2010

(54) DEEP WATER HURRICANE VALVE

(75) Inventors: Douglas J. Lehr, The Woodlands, TX (US); Jason C. Mailand, The Woodlands, TX (US)

(73) Assignee: BJ Services Company LLC, Houston, TX (US)

( * ) Notice: Subject to any disclaimer, the term of this patent is extended or adjusted under 35 U.S.C. 154(b) by 420 days.

(21) Appl. No.: 11/879,876

(22) Filed: Jul. 19, 2007

(65) Prior Publication Data

US 2009/0020295 A1 Jan. 22, 2009

(51) Int. Cl.
*E21B 33/12* (2006.01)

(52) U.S. Cl. ..... 166/386; 166/135; 166/192

(58) Field of Classification Search ..... 166/135, 166/192, 319, 386, 184, 183
See application file for complete search history.

(56) References Cited

U.S. PATENT DOCUMENTS 1,972,791 A * 9/1934 Otis ..... 166/133
3,288,221 A * 11/1966 Howard et al. ..... 166/183
3,804,167 A * 4/1974 Swift ..... 166/321
4,372,392 A * 2/1983 Barrington et al. ..... 166/373
5,154,228 A * 10/1992 Gambertoglio et al. ..... 166/124
5,181,569 A * 1/1993 McCoy et al. ..... 166/317
5,188,180 A * 2/1993 Jennings ..... 166/338
5,931,229 A * 8/1999 Lehr et al. ..... 166/278
6,182,762 B1 * 2/2001 Harris ..... 166/339
7,168,493 B2 * 1/2007 Eddison ..... 166/334.4
2004/0159447 A1 * 8/2004 Bissonnette et al. ..... 166/386

* cited by examiner

*Primary Examiner*—William P Neuder
(74) *Attorney, Agent, or Firm*—Zarian Midgley & Johnson PLLC

(57) ABSTRACT

A storm plug for temporarily isolating an offshore well in deep water includes a retrievable service packer connected to a valve housing containing a movable isolation sleeve and a standing valve. The standing valve precludes the fluid flow through a portion of the isolation sleeve. The isolation sleeve being hydraulically actuated from an open position to a closed position. In the open position, fluid may flow through flow ports in the standing valve to an annular bypass area between the valve housing and the isolation sleeve. In the closed position, the isolation sleeve prevents fluid flow through the valve housing. The valve may be hydraulically actuated as compared to conventional storm valve that are set by workstring rotation. The running tool used to run the storm plug into the well may be hydraulically disconnected from the valve housing.

22 Claims, 18 Drawing Sheets

DEEP WATER HURRICANE VALVE

BACKGROUND OF THE INVENTION

1. Field of the Invention

The present invention relates generally to a method and a storm plug that may be used to temporarily isolate an offshore oil or gas well. The storm plug, also known as a hurricane plug, includes a retrievable service packer and a valve that may be hydraulically actuated to prevent fluid flow through the valve. The valve may include a valve housing with a standing valve and a hydraulically movable isolation sleeve positioned within the valve housing. The isolation sleeve may be positioned such that in combination with the standing valve fluid flow through the valve housing is precluded. The hydraulic actuation of the valve eliminates the need to rotate a workstring to open and close the valve and also may prevent the unintentional opening of the valve due to rotation of the workstring during the installation of retrievable service packer and tailpipe into the well.

2. Description of the Related Art

The need to secure an offshore oil or gas well during storm conditions, or while performing maintenance on wellheads, requires the use of a "storm plug." A storm plug assembly consists of a retrievable service packer and valve, the valve also being known in the industry as a storm valve or a hurricane valve. Storm plugs are placed in the cased hole at a location that is typically 200 ft. below the mudline, meaning 200 ft. below the ocean floor. In traditional "shelf" applications, since jack-up rigs operate at maximum depths of around 300 ft., storm plugs will be set at maximum depths of perhaps 500 ft. In deep water applications, in which floating drill ships or semi-submersible rigs operate in water depths of 6,000 ft. or more the setting depth for the storm plug will be perhaps 6,200 ft, or more.

Operation of storm plugs at setting depth is traditionally mechanical, whereby the retrievable service packer is set using right-hand rotation, and afterwards, the storm valve is closed with left-hand rotation. Implicit in this operation is the recovery of the workstring, so the left-hand rotation of the valve serves a second purpose, that being to disconnect the workstring from the storm plug. Hence the storm plug is left in the cased hole until the threat of storm has passed or topside maintenance is completed. At a future time when downhole operations must be resumed, the storm plug is retrieved to allow drilling or completion activities through the cased hole. This is achieved by running the workstring to the top of the valve and gently tagging it with a force between 5,000 and 10,000 pounds, then slowly rotating the workstring right hand to re-engage the thread in the top of the valve. Once engaged, the storm plug is retrieved and removed from the wellbore.

At shelf depths, workstring rotation may be accurately achieved using pipe wrenches or top drive units. However, in deep water wells, rotation using any means may be inaccurate leading to problems with disconnecting or inadvertently opening the valve. Also, since rotation with high torque is frequently required to get the storm plug to setting depth (due to hole deviation), the valve can be damaged prior to setting and disconnect from the workstring. Typically a tailpipe or the drill string is connected to the bottom of the retrievable service packer to provide weight on the packer as well as to protect the drill string while the well is temporarily isolated. Deep water wells may increase the need to rotate the workstring to insert the tailpipe into the well.

Therefore it would be beneficial to provide a storm plug that may be used to temporarily isolate a well in deep water that may be closed by hydraulic means rather than by rotation of the workstring. It would also be beneficial to provide a storm plug that can withstand application of extremely high right hand torque while being run into the well without concern of damaging or disconnecting the device. It would be beneficial to provide a storm plug designed to handle the extremely high tailpipe loads typical of deep water storm plug installations. It would also be beneficial to provide a storm plug that is adapted to keep the valve mechanism open while running in the hole automatically filling the work string with fluid permitting the circulation fluids prior to closing the valve mechanism.

The invention of the present disclosure is directed to overcoming, or at least reducing the effects of, one or more issues set forth above.

SUMMARY OF THE INVENTION

The invention of the present disclosure is directed to a storm plug, and method for temporarily isolating an offshore well in deep water. Specifically, wherein the storm plug may be actuated by hydraulic means rather than by rotation of the workstring. According to one embodiment the storm plug includes a retrievable service packer and a valve. The valve includes an isolation sleeve and a standing valve within a valve housing, the standing valve preventing flow through at least a portion of the isolation sleeve. The upper end of the valve housing is in mechanical communication within a workstring and the lower end of the valve housing is in mechanical communication with the packer. The isolation sleeve may be hydraulically shiftable between an opened position and a closed position. In the opened position, fluid may flow through an annular bypass area between the valve housing and the isolation sleeve and in the closed position the isolation sleeve prevents fluid from flowing through the valve.

The valve of the storm plug may include a power piston connected to the isolation sleeve, the power piston responsive to a preselected hydraulic pressure to shift the isolation sleeve from the opened position to the closed position. One or more flow ports extending through the valve housing may permit external pressure to shift the power piston and the isolation sleeve. The isolation sleeve/power piston assembly may be releasably attached to the valve housing in the opened position by a shear mechanism. The shear mechanism may be a shear pin adapted to shear at a preselected pressure.

The valve of the storm plug may also include a locking mechanism for locking the isolation sleeve in the closed position. The locking mechanism may be a collet that snaps over a shoulder on the power piston. A latching mechanism, such as locking dogs, may be used to hold the collet relative to the valve housing. The latching mechanism may be released by shifting a release sleeve to align a recess on the inner diameter of the release sleeve latching mechanism. A running tool may be releasably connected to the storm plug. The running tool may be released by the application of a preselected amount of hydraulic pressure.

In one embodiment a system for temporarily abandoning an offshore well includes a retrievable service packer, a valve housing having an upper end and a lower end, the lower end in mechanical communication with the packer and the upper end in mechanical communication with a workstring. The system also includes an isolation sleeve positioned inside of the valve housing and being hydraulically shiftable between an opened position and closed position. A standing valve is positioned within the isolation sleeve and prevents the flow of fluid through at least a portion of the isolation sleeve. The valve housing includes at least one flow port through which hydraulic pressure may be applied to shift the isolation sleeve.

In the open position, the isolation sleeve permits fluid flow through an annular bypass area between the valve housing and isolation sleeve. In the closed position, the isolation sleeve prevents fluid flow through the valve housing. A power piston may be connected to the isolation sleeve. The power piston is selectively connected to the valve housing by a shear mechanism adapted to shear at a preselected hydraulic pressure and power piston is responsive to the preselected hydraulic pressure shift the isolation sleeve from the opened position to the closed position.

The system includes a running tool adapted to release from the valve housing at a preselected hydraulic pressure. The running tool is also adapted to mechanically release from the valve housing as a secondary releasing mechanism. The running tool of the system may include a collect having externally threaded fingers and a hydraulically movable support sleeve that in a first position expands outwardly the collet fingers and in a second position permits the inward movement of the collet fingers. The externally threaded collet fingers are adapted to engage a threaded section of the valve housing when expanded outwardly by the support sleeve.

The system may also include a locking mechanism that selectively locks the isolation sleeve in the closed position. The system may also include a retrieval tool that is adapted to engage a threaded section of the valve housing. The retrieval tool may engage a release sleeve that releases the locking mechanism that locks the isolation sleeve in the closed position.

One embodiment is a system that includes a retrievable service packer, a valve housing having a lower end and an upper end, the lower end of a valve housing in mechanical communication with the retrievable service packer, a standing valve positioned within the valve housing, and movable isolation sleeve positioned within the valve housing, and a retrieving tool. The retrieving tool is adapted to mechanically engage the upper end of the valve housing. The isolation sleeve being hydraulically actuated from a first position to a second position, wherein in the second position the isolation sleeve in combination with the standing valve prevents fluid flow through the valve housing. The system may include a locking mechanism to selectively secure the isolation sleeve at the second position and a movable release sleeve that releases the isolation sleeve from the second position, wherein the engagement of the retrieving tool moves the release sleeve.

One embodiment is a method for temporarily abandoning an offshore well that includes running into the offshore well a retrievable service packer and a valve having a lower end in mechanical communication with the retrievable service packer and an upper end in mechanical communication with a workstring, the valve adapted to allow fluid flow through the valve while being run into the well. The method also includes setting the retrievable service packer, preventing fluid flow through the valve, and removing the workstring from mechanical communication with the upper end of the valve. The valve is hydraulically actuated to prevent fluid flow through the valve.

One embodiment is a method to temporarily abandoning an offshore well that includes running a retrievable service packer and a valve into an offshore well, the valve including standing valve and a movable isolation sleeve both within a valve housing, a lower end of the valve housing being in mechanical communication with the retrievable service packer and an upper end of the valve housing being in mechanical communication with a workstring. The method includes setting the retrievable service packer and applying a preselected hydraulic pressure to the valve housing to move the isolation sleeve to a position that prevents fluid flow through the valve housing.

The method may include locking the isolation sleeve in the position that prevents fluid flow through the valve housing. A running tool in releasable mechanical communication with the upper end of the valve housing may be used to run the retrievable service packer and the valve into the offshore well. The method may include applying a second preselected hydraulic pressure to release the running tool from the valve housing. The method may also include engaging a retrieval tool with the valve housing to retrieve the retrievable service packer and the valve. The method may include moving a release sleeve to unlock the isolation sleeve. The engagement of the retrieval tool may move the release sleeve within the valve housing. The method may also include retrieving the retrievable service packer and the valve from the offshore well with the retrieval tool after unlocking the isolation sleeve.

Figure 1:
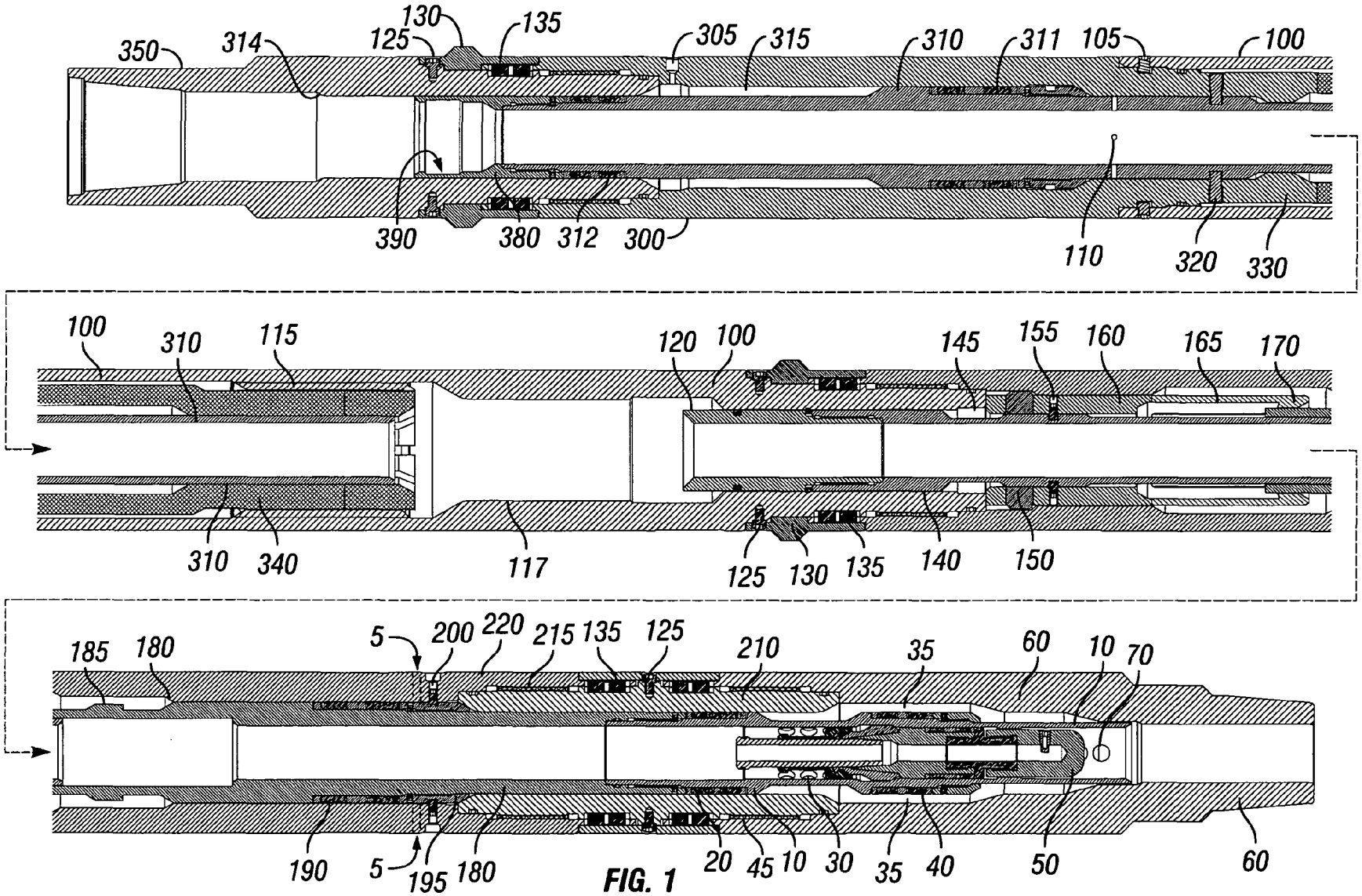
FIG. 1 shows a cross-section view of one embodiment of a storm valve for temporarily isolating an offshore well with a running tool connected to the storm valve.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in a storm plug and a method for temporarily isolating an offshore oil or gas well. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment of a storm valve that may be used as a component of a storm plug to temporarily isolate an offshore well. The lower end of the storm valve includes a bottom sub 60 that is in mechanical communication with a retrievable service packer 80 (shown in FIG. 7). Although retrievable service packers are used in the preferred embodiments, other types of commercially available packers, such as production packers, may be used with the present invention. Mechanical communication as used herein means directly connected to or indirectly connected to. One of ordinary skill in the art having the benefit of this disclosure will recognize that another sub(s)/connector(s) could be used to connect the bottom sub 60 to the retrievable service packer 80. The top end of the bottom sub 60 is in mechanical communication with an outer housing 220. The term "valve housing" may be used to refer to the assemblage of parts threaded together, held together with keys for anti-rotation purposes, and/or fastened together to constitute the outer housing of the storm valve. The valve housing may be comprised of various components such as subs and housings as would be appreciated by one of ordinary skill in the art having the benefit of this disclosure. The valve housing of the entire storm valve includes a central bore. A double pin sub 210 may be used to connect the outer housing 220 with the bottom sub 60. The double pin sub 210 may include a lower threaded section 45 to connect the double pin sub 210 to the bottom sub 60 and an upper thread section 215 to be connected to the outer housing 220.

Fasteners 125 may be used to connect together the various components of the housing of the storm valve. Anti-rotation keys 135 may be used to prevent various components of the housing from rotating with respect to each other. The anti-rotation keys 135 may prevent various threaded components of the storm valve from unintentionally becoming disconnected due to rotation of the workstring during the running of the storm plug into an offshore well.

The storm valve includes a standing valve 50 positioned within the central bore of the bottom sub 60 that diverts fluid flow within the central bore out of circulation ports 30 into an annular bypass area 35. Fluid flow may continue down the central bore through a port 70 in an isolation sleeve 10 and into the central bore of the bottom sub 60. The orientation and number of ports shown in the Figures is for illustrative purposes and may be varied within the spirit of the invention as would be appreciated by one of ordinary skill in the art having the benefit of this disclosure. The valve mechanism of the storm valve includes the isolation sleeve 10 in combination with the standing valve 50.

Figure 2:
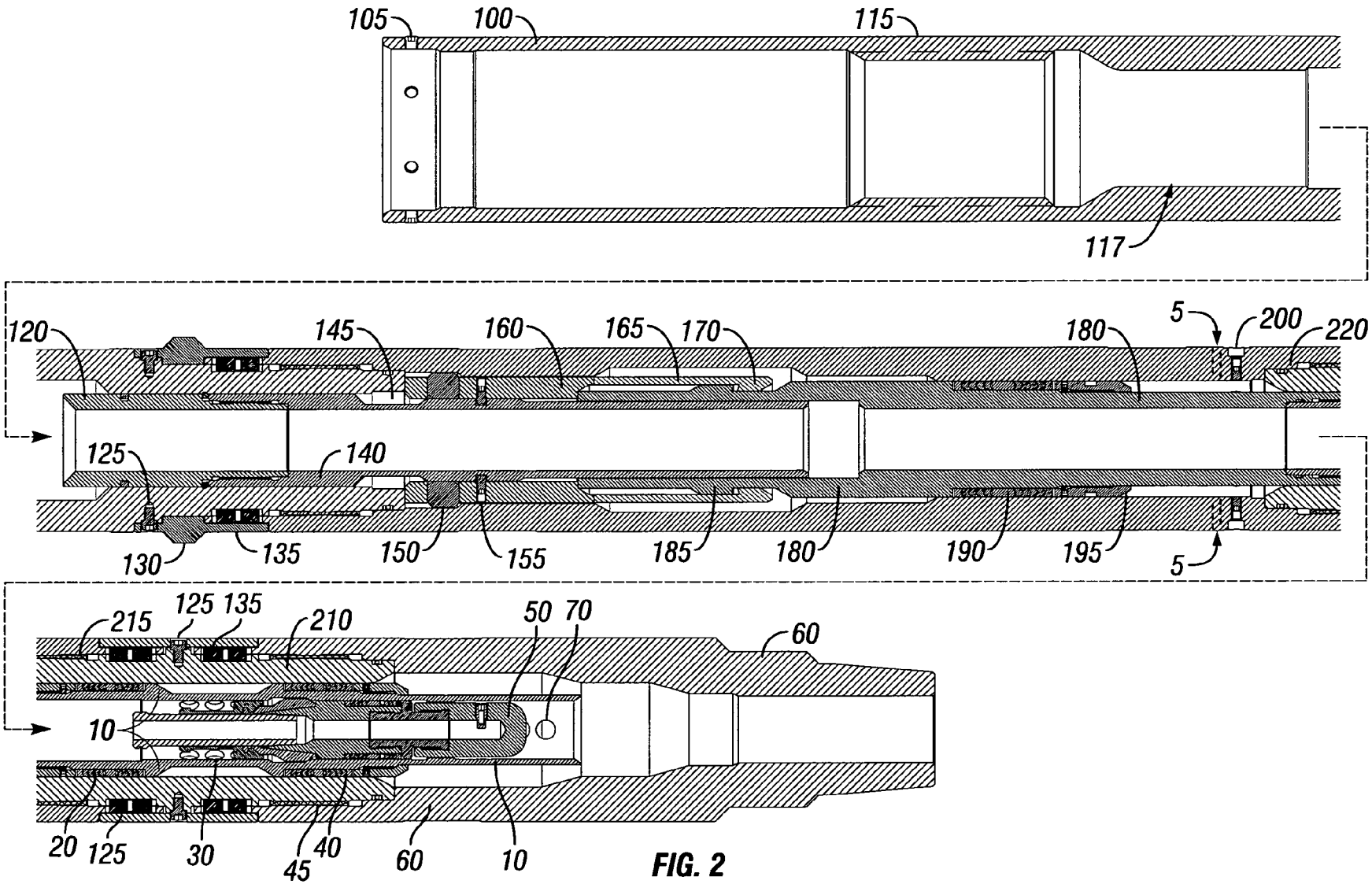
FIG. 2 shows a cross-section view of the embodiment of FIG. 1 with the valve mechanism of the storm valve closed and the running tool disconnected.

The upper end of the standing valve 50 is connected to the isolation sleeve 10 that is movable from an open or lower position as shown in FIG. 1 to a closed or upper position as shown in FIG. 2. The isolation sleeve 10 includes upper seals 20 and lower seals 40. When the isolation sleeve 10 is in the lower position the upper seals 20 create a fluid seal with the double pin sub 210, but the lower seals 40 do not contact any portion of the valve housing allowing fluid to flow down the annular bypass area 35 and through the port 70 at the lower end of the isolation sleeve.

Figure 3:
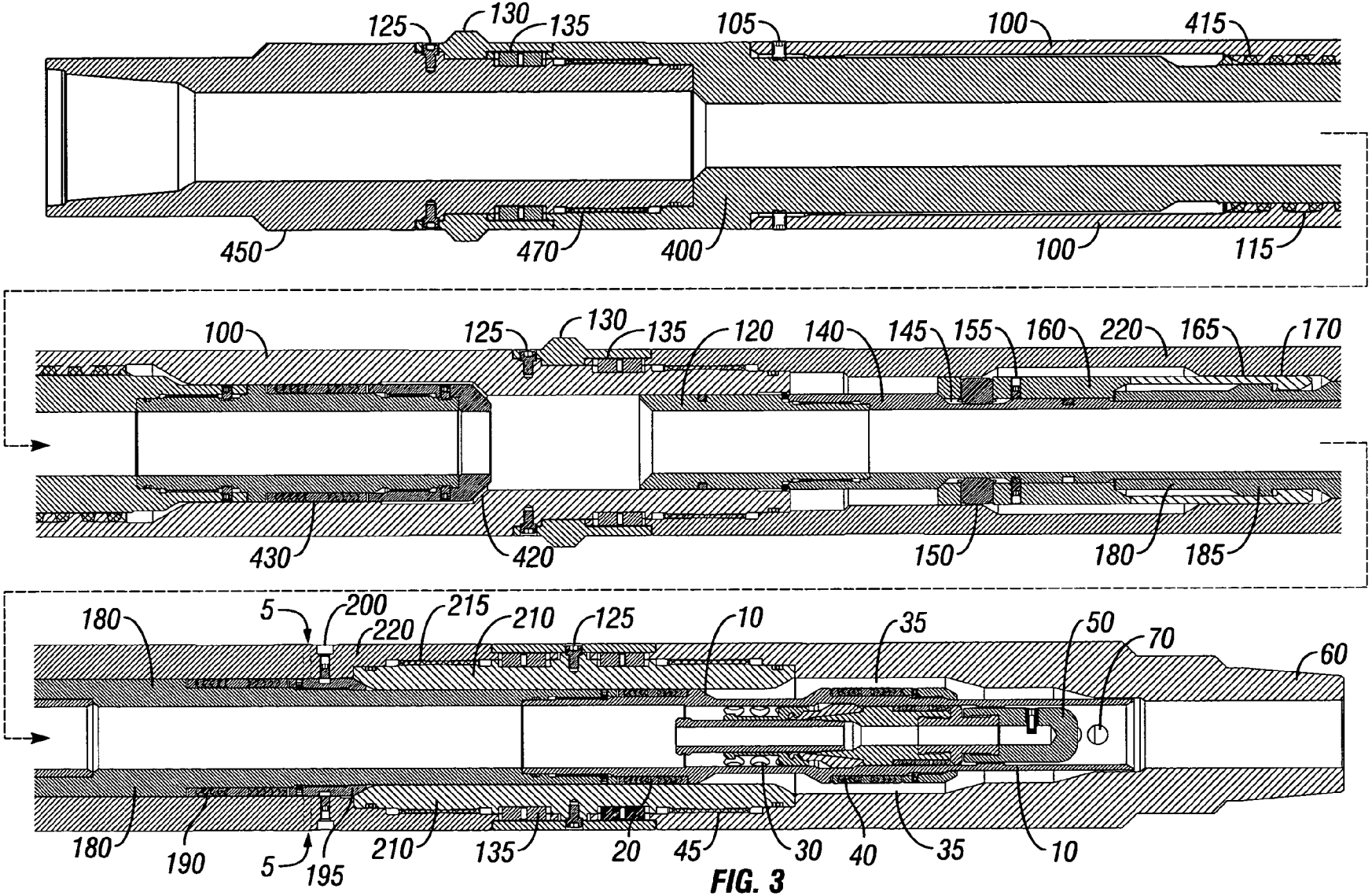
FIG. 3 shows a cross-section view of the embodiment of FIG. 1 with a retrieval tool connected to the storm valve.

The isolation sleeve 10 is in mechanical communication with a power piston 180 located within the central bore of the valve housing. One or more shearable devices 200, such as shear screws, are in mechanical communication with the power piston 180 to selectively connect the power piston 180 to the outer housing 220. A latching mechanism 195 may be connected to the power piston 180 to engage the shearable device retaining the power piston 180 and isolation sleeve 10 at an open or lower position while the storm plug is being run into the well. The storm valve includes a locking mechanism to retain the power piston 180 and isolation sleeve 10 in the closed or upper position. The locking mechanism as shown in FIGS. 1-3 is a collet 160 having collet fingers 165 that include a shoulder 170 at the lower end of the collet fingers 165. The shoulder 170 of the collet fingers 165 and the collet 160 retain the power piston 180 in a closed position as detailed below. The collet and collet fingers as a locking mechanism is for illustrative purposes only and could be various other locking means such as a locking ring or a set of locking dogs as would be appreciated by one of ordinary skill in the art having the benefit of this disclosure.

The top end of the outer housing 220 is connected to the lower end of a receptacle 100 which includes a central bore as discussed above. The outer housing 220 and the receptacle 100 may be threaded together. The valve housing may include a centralizer 130 to help center the storm valve as it is run into the well. The centralizer 130 may be connected to the valve housing by a fastener 125 and may include anti-rotation keys 135 to prevent rotation between the outer housing 220 and the receptacle 100. The upper portion of the receptacle 100 is in mechanical communication with a running tool 300. The central bore of the receptacle includes a threaded section 115 that engages the threaded exterior of collet fingers 340 of the running tool 300.

Figure 4:
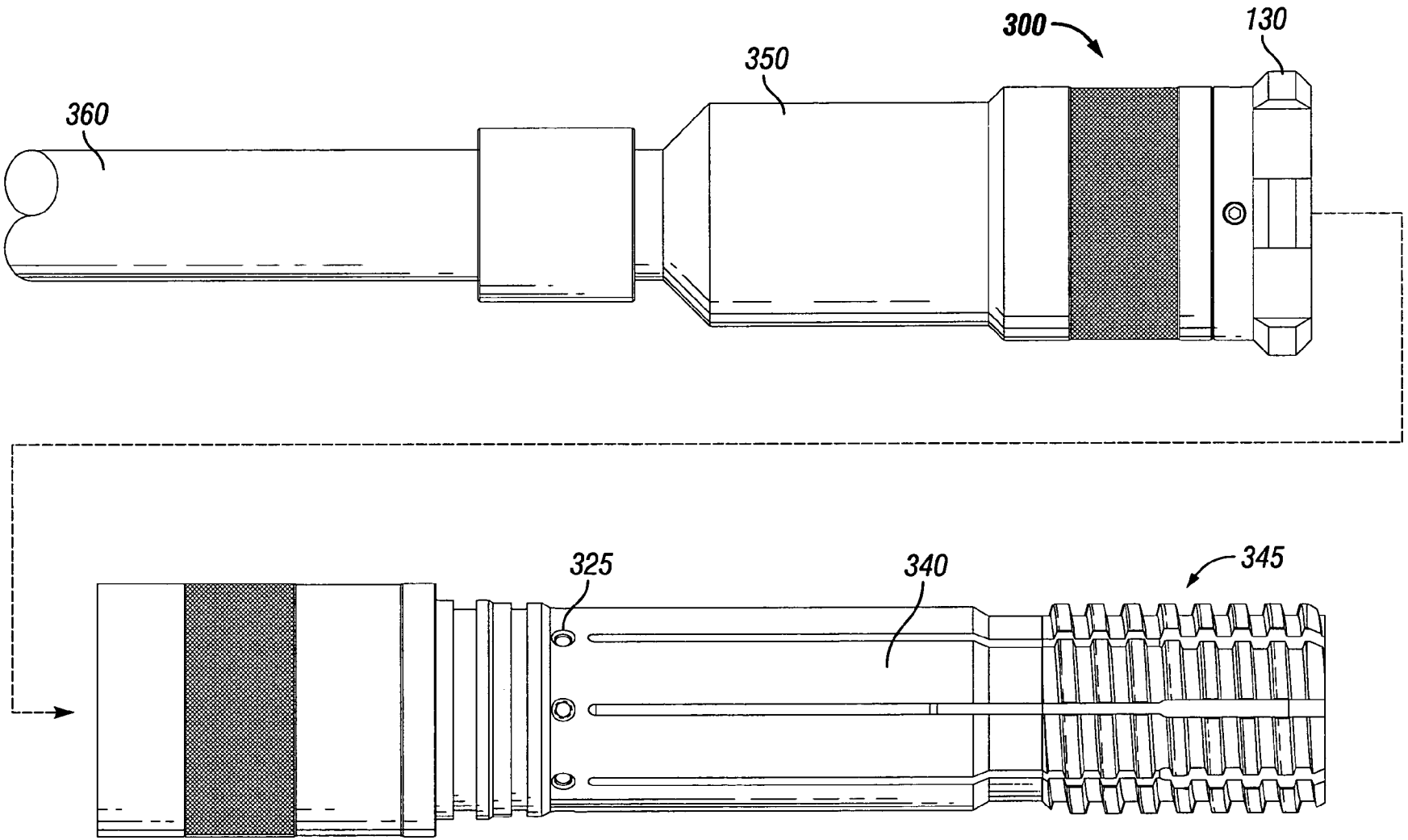
FIG. 4 shows an isometric view of one embodiment of a running tool.
Figure 6:
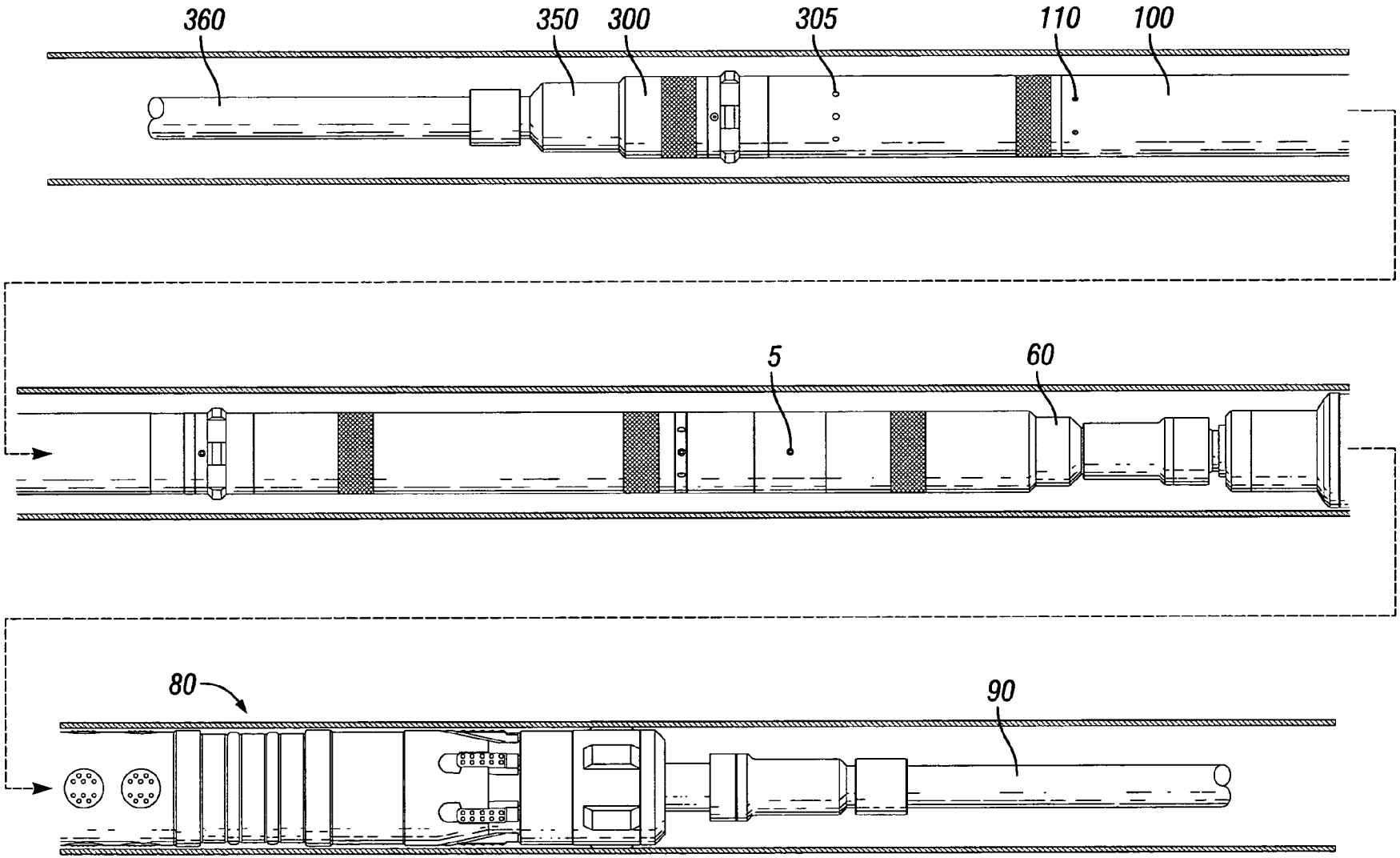
FIG. 6 shows an isometric view a storm plug for temporarily isolating an offshore well, the storm plug connected to a workstring.

The running tool 300 is in mechanical communication with valve housing of the storm valve and is used to run the storm plug into an offshore well. The running tool 300 includes a movable support sleeve 310 that in its initial position expands the collet fingers 340 of a collet 330 into engagement with the threaded section 115 of the receptacle 100. The external threads of the collet fingers 340 in combination with the support sleeve 310 provides that the running tool 300 may be threadedly connected with the receptacle 100. One or more shearable devices 105, such as shear pins or shear screws, provide an additional releasable means connecting the running tool 300 to the receptacle 100. A top sub 350 may be connected to the upper end of the running tool 300 so that the running tool 300 may be in mechanical communication with a workstring, or drill pipe, 360 as shown in FIGS. 4 and 6. A fastener 125 may connect a centralizer 130 to the top sub 350 to help center the storm valve as it is run into the well. Anti-rotation keys 125 may be used to prevent rotation between the top sub 350 and the running tool 300.

Figure 17:
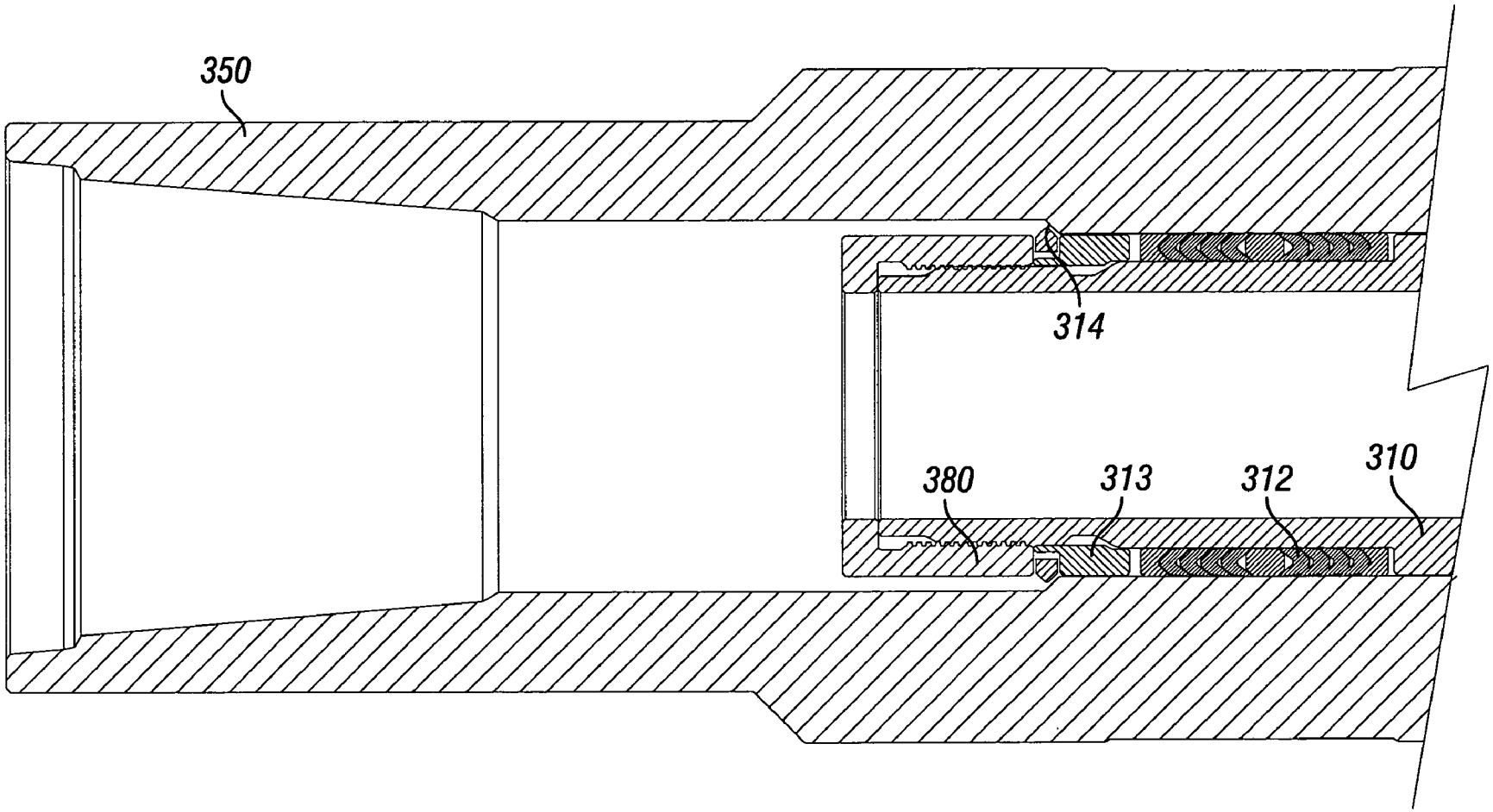
FIG. 17 shows one embodiment of a retaining ring that may be used to retain the support sleeve in its upward position releasing the running tool from the storm valve.

After the retrievable service packer has been set and the isolation sleeve 10 has been moved to the closed position as discussed in detail below, the running tool 300 may be hydraulically released from the receptacle 100. Pressure may be applied to the central bore of the running tool. The hydraulic pressure applies an upward force on the support sleeve 310 due to the lower seals 311 of the support sleeve having a larger diameter than the upper seals 312 of the support sleeve 310. Thus, a larger force is applied to the lower seals 311 of the support sleeve 310. The support sleeve 310 may be selectively secured at its initial position by a shearable device 320, such as a shear pin or shear screw, that is adapted to shear at a preselected pressure within the central bore of the running tool 300. Once the shearable device 320 has sheared releasing the support sleeve 310, the hydraulic pressure will move the support sleeve 310 up the central bore of the running tool 300. The support sleeve sub 380 may include a retaining ring 313 (shown if FIG. 17) that engages a shoulder 314 in the top sub 350 to retain the support sleeve 310 in the upper position. The retaining ring 313 shown in FIG. 17 is for illustrative purposes only as various devices may be used to retain the support sleeve 310 in its upper position as would be appreciated by one of ordinary skill in the art.

An upper communication port(s) 305 in the running tool 300 allows fluid contained within a recess 315 between the support sleeve 310 and the running tool 300 to exit the recess 315 as the support sleeve 310 moves up the running tool 300. A lower communication port 110 helps to prevent pressure from building up due to fluid trapped between the support sleeve 310 and the receptacle 100. The collet fingers 340 will collapse inwards as the support sleeve 310 moves up the running tool 300 and out of contact with the collet fingers 340. The collapse of the collet fingers 340 releases the bottom of the running tool 300 from threaded engagement with the receptacle 100. An upwards force may then be applied to the running tool 300 through the workstring 360 and the top sub 350 until the shearable devices 105 break releasing the running tool 300 from the storm valve. In the event that hydraulic control is lost or unavailable to shift the support sleeve 310 up the running tool 300, the running tool 300 may be removed from the storm valve by rotation of the workstring 360. Rotation of the workstring 360 will shear the shearable devices 105 allowing the collet fingers 340 to be rotated and unthreaded from the threaded section 115 of the receptacle 100. Alternatively, a standard setting profile 390 in the support sleeve sub 380 may permit the support sleeve 310 to be shifted up mechanically by a shifting or setting tool to shear pins 320 releasing the support sleeve 310.

FIG. 2 shows the storm valve with the valve mechanism closed and the running tool 300 removed from the top of the receptacle 100. The valve mechanism of the storm valve is closed by hydraulically shifting the isolation sleeve 10 to the closed position. The valve mechanism of the storm valve includes a commercially available wireline conveyed standing valve 50 in combination with an isolation sleeve 10 that may be hydraulically actuated. The isolation sleeve 10 includes upper seals 20 and lower seals 40. In the initial or open position, the upper seals 20 of the isolation sleeve 10 seal against the double pin sub 210, but the lower seals 40 are positioned below the double pin sub 210 allowing fluid to flow through the circulation ports 30 and bypass the standing valve 50.

To close the valve mechanism, hydraulic pressure is applied to the well casing which is applied to the annular area of the storm valve through communication ports 5 through the outer housing 220. The increased pressure within the storm valve applies an upward force on the power piston 180 due to the larger diameter bore of the power piston seals 190 with respect to the bore diameter of the upper seals 20 of the isolation sleeve. The pressure within the casing is increased to a predetermined amount at which the shearable devices 200 are adapted to shear releasing the latching mechanism 195 allowing the power piston 180 to move up the outer housing 220. The power piston 180 moves the isolation sleeve 10 up the storm valve positioning the lower seals 40 against the double pin sub 210. The lower seals 40 seal against the double pin sub 210 preventing fluid flow into the annular bypass area 35 to bypass the standing valve 50. The closed isolation valve 10 in combination with a set retrievable service packer 80 temporarily closes off the offshore well.

A collet 160 with collet fingers 165 are used to lock the power piston 180 and the isolation sleeve 10 into the closed position. The power piston 180 includes a shoulder 185 that engages a shoulder 170 on the collet fingers 165 as the power piston 180 moves up the central bore of the outer housing 220. The shoulder 170 of collet fingers 165 engages the shoulder of the power piston 185 preventing the downward movement of the power piston 180 and the isolation sleeve 10. After reaching the closed position, further upward movement of the power piston 180 is prevented as the upper end of the power piston 180 contacts the collet 160. Thus, the collet 160 and collet fingers 165 prevent further movement of the power piston 180 and the isolation sleeve 10 until the insertion of a retrieval tool to retrieve the storm plug.

Once it is no longer necessary to isolate the offshore well, a retrieval tool 400 as shown in FIG. 3 may be run on a workstring 460 to open the storm valve and retrieve the storm plug. The use of the storm plug of the present disclosure in an offshore well is for illustrative purposes only as the disclosed storm plug may also be used to temporarily isolate an onshore well as would be recognized by one of ordinary skill in the art having the benefit of this disclosure. The retrieval tool 400 includes a threaded section 415 that may be threaded into the threaded section 115 of the receptacle. An upper sub 450 may be used to connect the retrieval tool 400 to the workstring 460. The upper sub 450 may be threadedly connected 470 to the retrieval tool 400 and may include a centralizer 130 and anti-rotation keys 135 to prevent rotation between the upper sub 450 and the retrieval tool 400.

The lower end of the retrieval tool 400 includes a nose 420 that contacts a release sleeve 120 as the retrieval tool 400 is threaded into the receptacle 100. The release sleeve 120 is connected to a locking sleeve 140. The contact from the nose 420 of the retrieval tool 400 causes a downward force of the release sleeve 120 and the locking sleeve 140 shearing one or more shearable devices 155 that selectively connect the locking sleeve to the collet 160. The shearing of the shearable devices 155 allow the release sleeve 120 and locking sleeve 140 to move down the inner bore of the storm valve as shown in FIG. 3. Preferably the nose 420 of the retrieval tool 400 causes the shearable devices 155 to shear a few turns before the threaded section 415 is completely seated within the threaded section 115 of the receptacle. In the initial position, the locking sleeve 140 supports the locking dogs 150 in an expanded position, the locking dogs 150 being connected to the collet 160. The locking sleeve 140 includes a recessed portion 145 into which the locking dogs 150 may collapse when the recessed portion 145 reaches the location of the locking dogs 150 as the locking sleeve 140 travels down the central bore of the storm valve. The configuration of the release sleeve 120, locking sleeve 140, recess 145, and locking dogs 150 are for illustrative purposes and may be varied within the spirit of the invention as would be appreciated by one of ordinary skill in the art having the benefit of this disclosure.

The collapse of the locking dogs 150 into recess 145 of the locking sleeve 140 creates an assembly including the release sleeve 120, the locking sleeve 140, the collet 160, the collet fingers 165, the power piston 180, and the isolation sleeve 10. The collapse of the locking dogs 150 into the recess 145 also releases the collet 160 from the outer housing 220 unlocking the power piston 180 and the isolation sleeve 10. The power piston/isolation sleeve assembly is now free to move down along the central bore of the storm valve.

The valve mechanism in the storm valve needs to be opened prior to removal of the storm plug from the well. Prior to temporarily isolating an offshore well, kill fluid is pumped into the well to prevent the production of fluids from the well. If there has been no unanticipated fluid loss to the reservoir during the isolation period, the pressure below the standing valve 50 should be balanced and the power piston/isolation sleeve assembly will probably remain in the closed or upper position. The workstring may be pressured up to move the power piston/isolation sleeve assembly down the central bore of the storm valve to the open or lower position. The outer housing of the storm valve includes a shoulder to prevent further downward movement of the isolation sleeve 10 past its lower or open position. The embodiment shown in FIGS. 1-3 illustrate that latching mechanism 195 connected to the isolation sleeve 10 will contact the double pin sub 210 preventing further downward movement once the isolation sleeve 10 has reached its lower position. If fluid has been lost to the reservoir, the pressure beneath the closed valve should be less than above. In this situation, the increased pressure above the closed valve will move the isolation sleeve to the open or lower position once the power piston/isolation sleeve assembly is unlocked.

Alternatively, if the pressure below the closed valve exceeds the hydrostatic pressure above the closed valve, the power piston/isolation sleeve assembly will remain in the closed position even after the assembly has been unlocked by the retrieval tool. The retrieval tool 400 includes seals 430 that engage a seal bore 120 of the receptacle providing control of the well. The pressure within the workstring may be slowly increased until it exceeds the downhole pressure moving the power piston/isolation sleeve assembly to the open position opening the valve mechanism in the storm valve.

FIG. 4 shows one embodiment of a running tool 300 that may be used to run the storm plug into an offshore well. The upper end of the running tool 300 includes a top sub 350 connected to a workstring 360. The running tool 300 may include a centralizer 130 to help center the tool and storm plug within the well. The lower end of the running tool 300 includes collet fingers 340 that include an exterior threaded portion 345 that is adapted to thread into the thread section 115 of the receptacle 100. The running tool 300 may include a plurality of openings 325 to allow one or more shearable devices to selectively connect the running tool 300 to the receptacle 100 of the storm plug.

Figure 5:
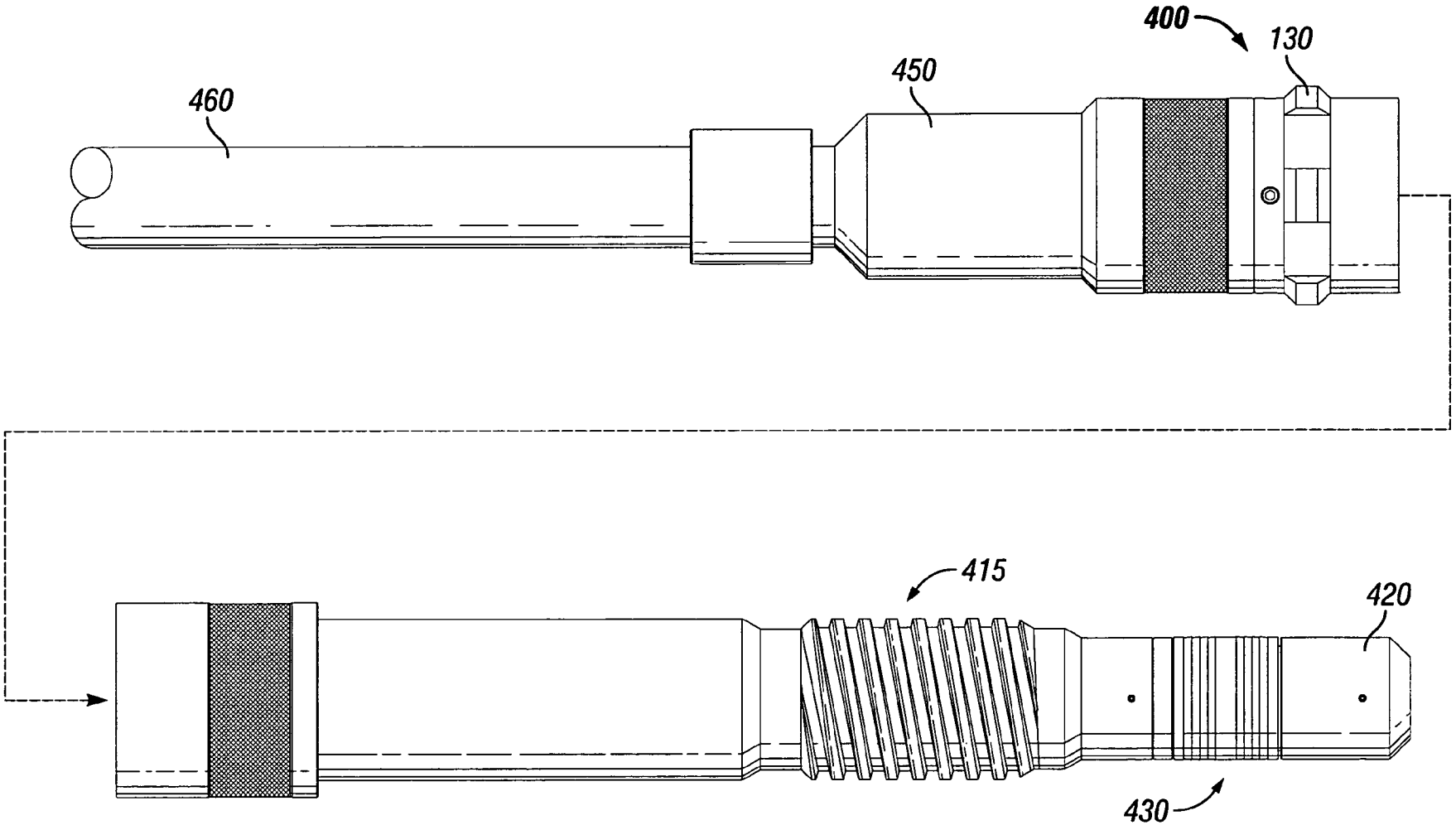
FIG. 5 shows an isometric view of one embodiment of a retrieval tool.

FIG. 5 shows one embodiment of a retrieval tool 400 that may be used to retrieve the storm plug from an offshore well. The upper end of the retrieval tool 400 includes a top sub 450 that may be connected to a workstring 460. The retrieval tool 400 may include a centralizer 130 to help center the storm valve within the well. The retrieval tool 400 includes a threaded section 415 that is adapted to engage the threaded section 115 of the receptacle 100. The retrieval tool 400 includes seals 430 that may seal in a seal bore of the receptacle as well as a nose 420 engage a releasing sleeve of the storm plug.

Figure 7:
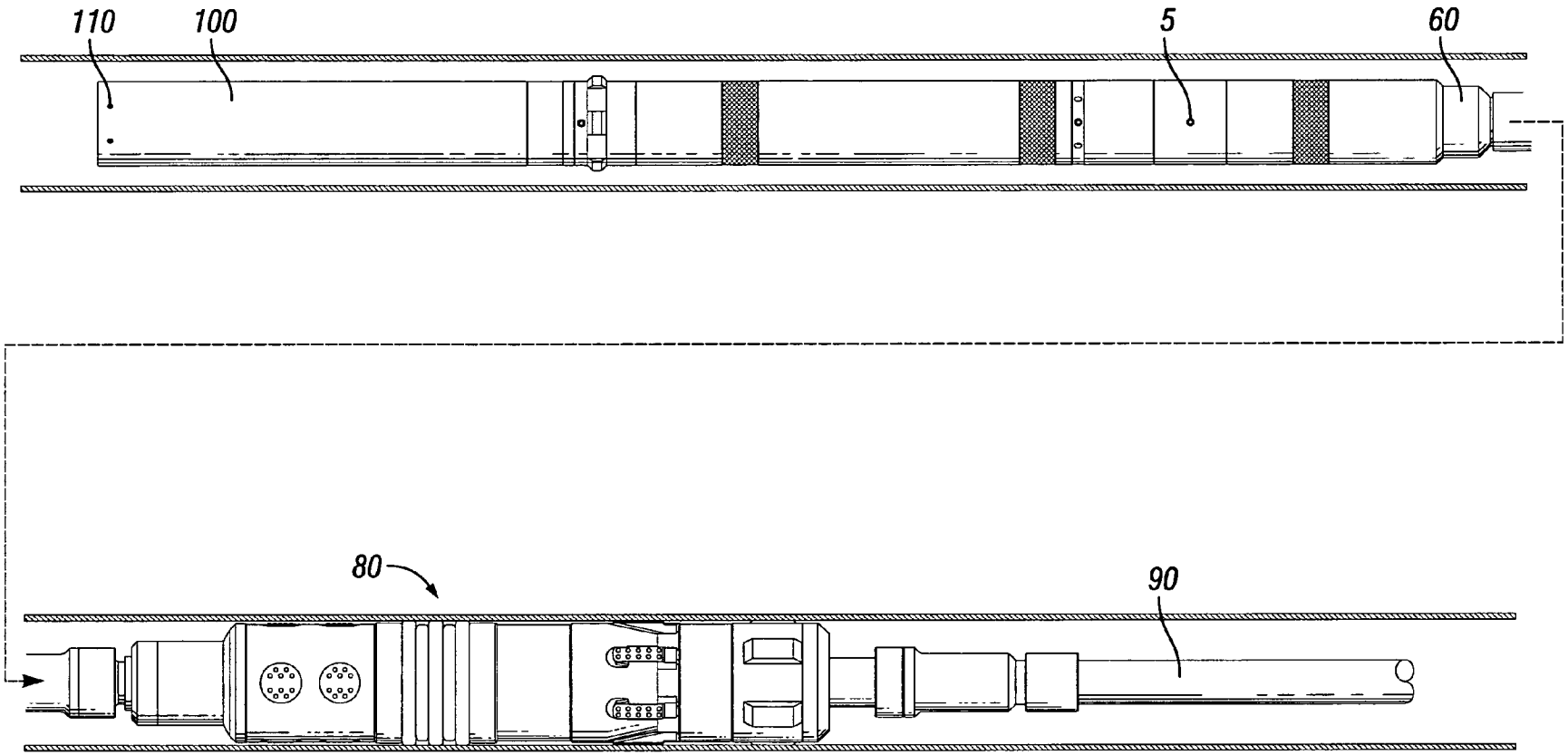
FIG. 7 shows an isometric view of a storm plug for temporarily isolating an offshore well with the workstring disconnected and the storm plug set to isolate the well.

FIG. 6 shows an isometric view of a workstring 360 running the storm plug into an offshore well. A top sub 350 connects the workstring 360 to a running tool 300. The running tool is connected to the upper end of the receptacle of the storm valve. A bottom sub 60 connects a retrievable service packer 80 to the bottom of the storm valve. A tailpipe 90 is connected to the bottom of the packer 80. FIG. 7 shows that packer 80 set within the well and the running tool disconnected from the receptacle 100.

Figure 8:
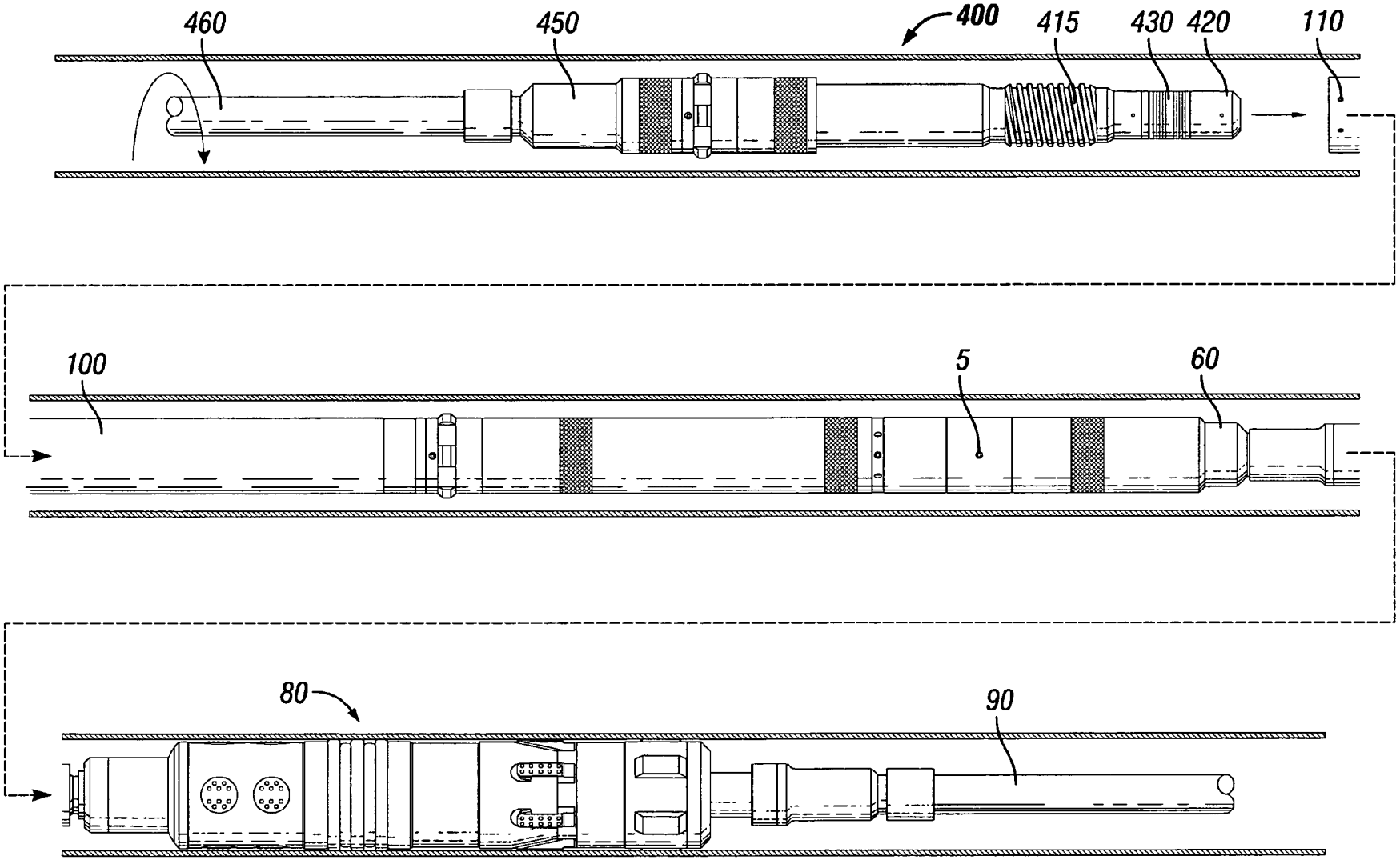
FIG. 8 shows an isometric view of a retrieval tool connected to a workstring being run into a well to retrieve a set storm plug for temporarily isolating an offshore well.
Figure 9:
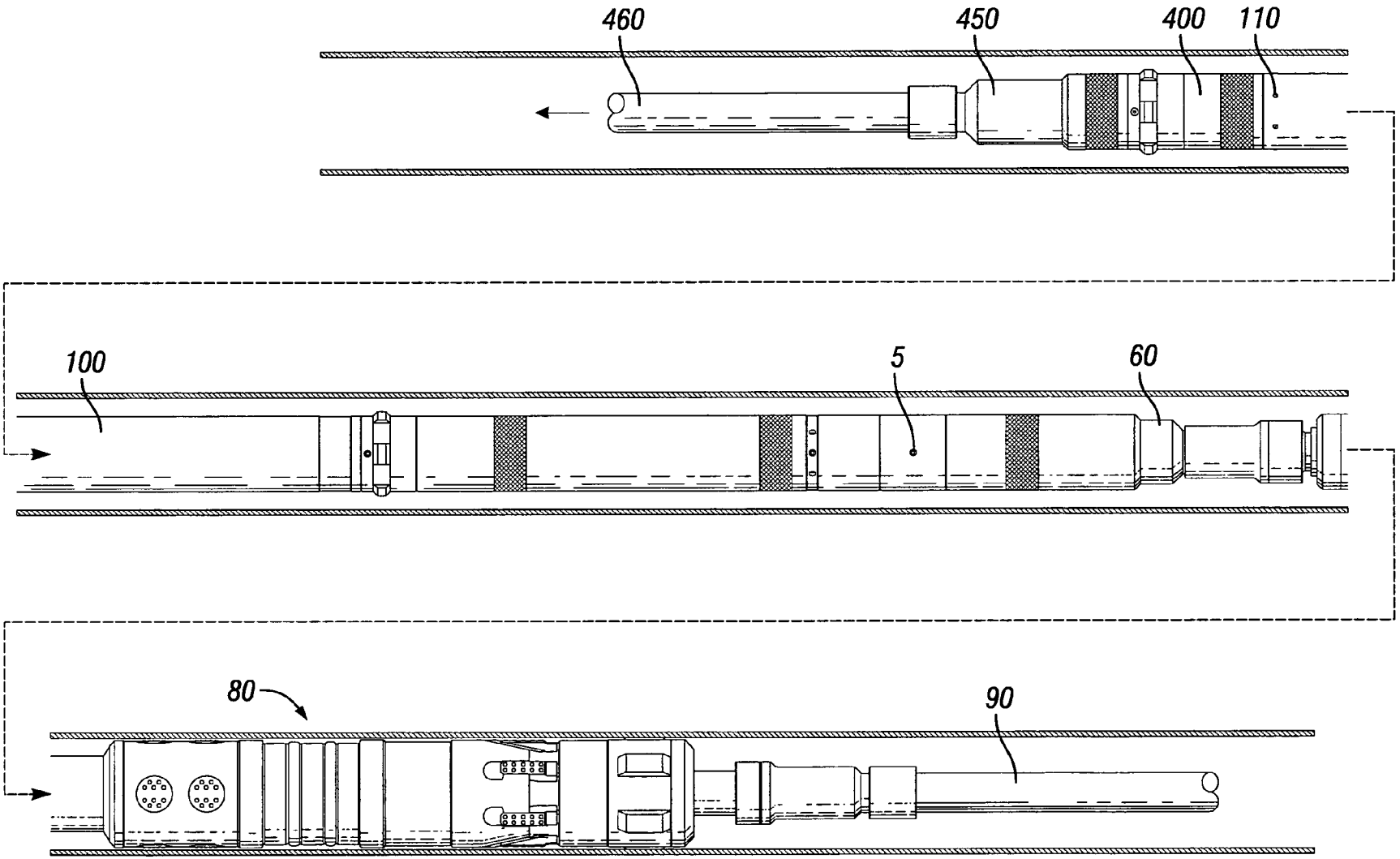
FIG. 9 shows an isometric view of the retrieval tool of FIG. 8 connected to the storm plug for temporarily isolating an offshore well.

FIGS. 8 and 9 show the retrieval of the storm plug from the offshore well. A retrieval tool 400 connected to a workstring 460 by a top sub 450 is run into the well as shown in FIG. 8. The retrieval tool 400 is connected to the receptacle 100 of the storm valve. After the packer 80 has been unset, the workstring 460 may be used to retrieve the storm valve, the packer 80, and the tailpipe 90 from the well.

Figure 10:
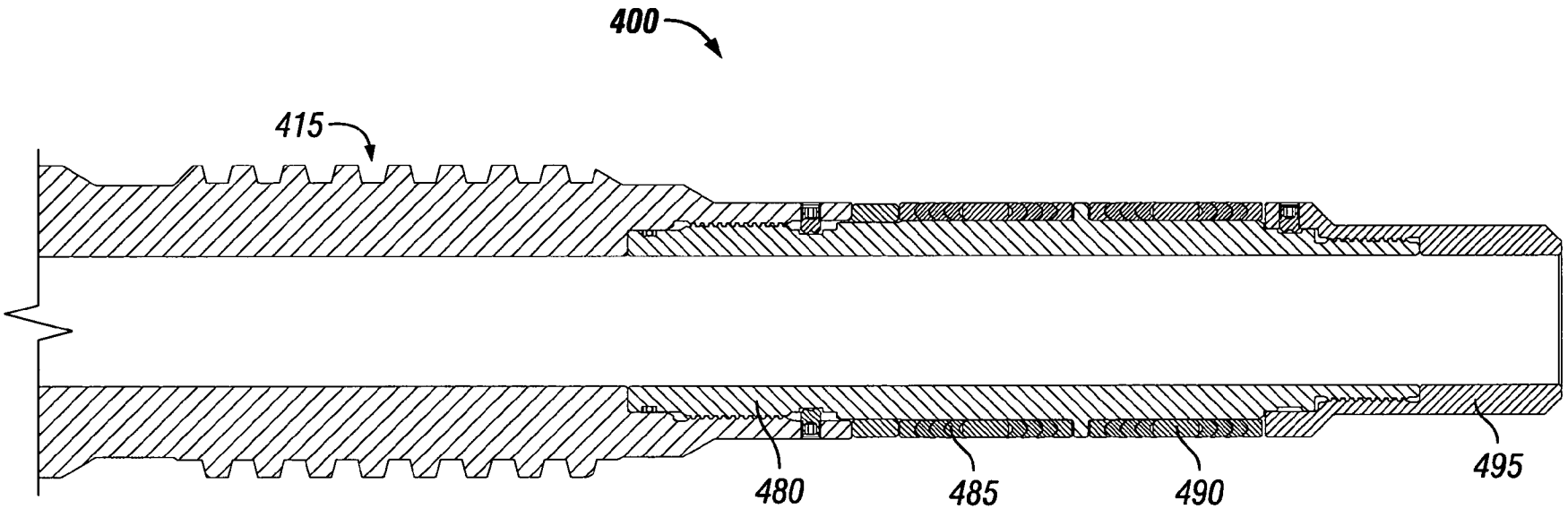
FIG. 10 shows a cross-section view of the end of one embodiment of a retrieval tool that may be used to manually move the valve mechanism of the storm valve to the open position.

FIG. 10 shows another embodiment of the lower end of a retrieval tool 400 that may be used to retrieve the storm plug from an offshore well. The retrieval tool 400 includes a threaded section 415 that is adapted to engage the threaded section 115 of the receptacle 100. The lower end of the retrieval tool 400 includes a seal sub 480 that includes two sets of seals 485, 490. At the end of the seal sub 480 is a nose 495 that is adapted to engage the releasing sleeve of the storm valve. The longer length of the seal sub 480 is adapted to move the isolation sleeve 10 to the lower or open position upon the complete engagement of the threaded section 415 of the retrieval tool 400 with the threaded section 115 of the receptacle 100. This increased length allows the operator to move the valve mechanism of the storm valve to the open position upon complete insertion of the retrieval tool 400, even if there is an increase in pressure below the valve mechanism. The dual seals 485, 490 of the seal sub 480 ensure that the bore is sealed prior to the movement of the isolation sleeve 10 to the open position.

Figure 11:
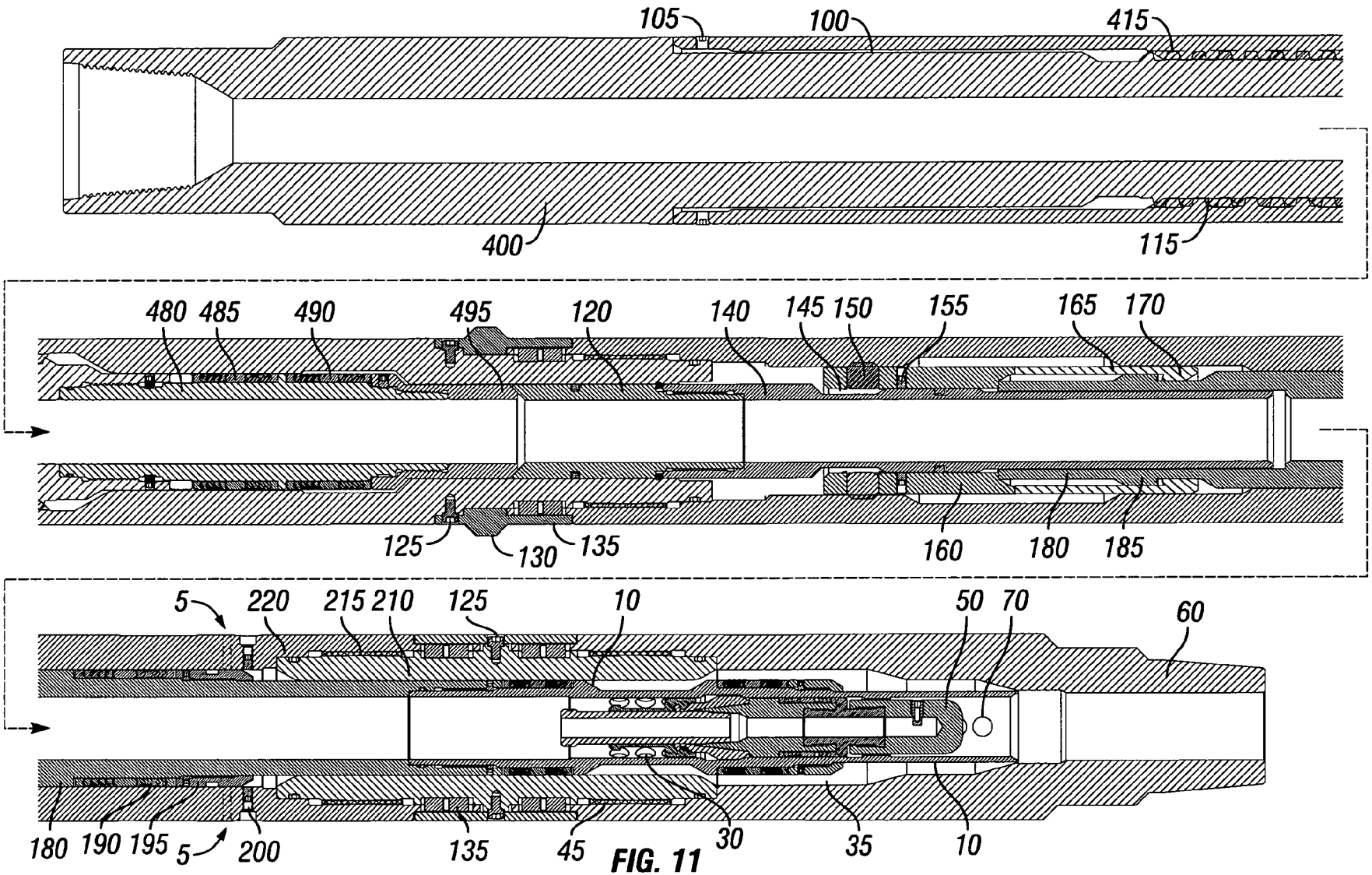
FIG. 11 shows the retrieval tool of FIG. 10 threaded into the receptacle of the storm valve.

FIG. 11 shows the retrieval tool 400 of FIG. 10 threaded into the receptacle 100 of the storm valve. The nose 495 of the retrieval tool 400 engages the releasing sleeve 120, which is connected to the isolation sleeve 10 through the power piston 180 and the locking sleeve 140. The length of the seal sub 480 of this embodiment of the retrieval tool 400 causes the movement of the isolation sleeve 10 to the lower or open position upon complete engagement of the retrieval tool 400 within the receptacle 100 of the storm valve.

Figure 12:
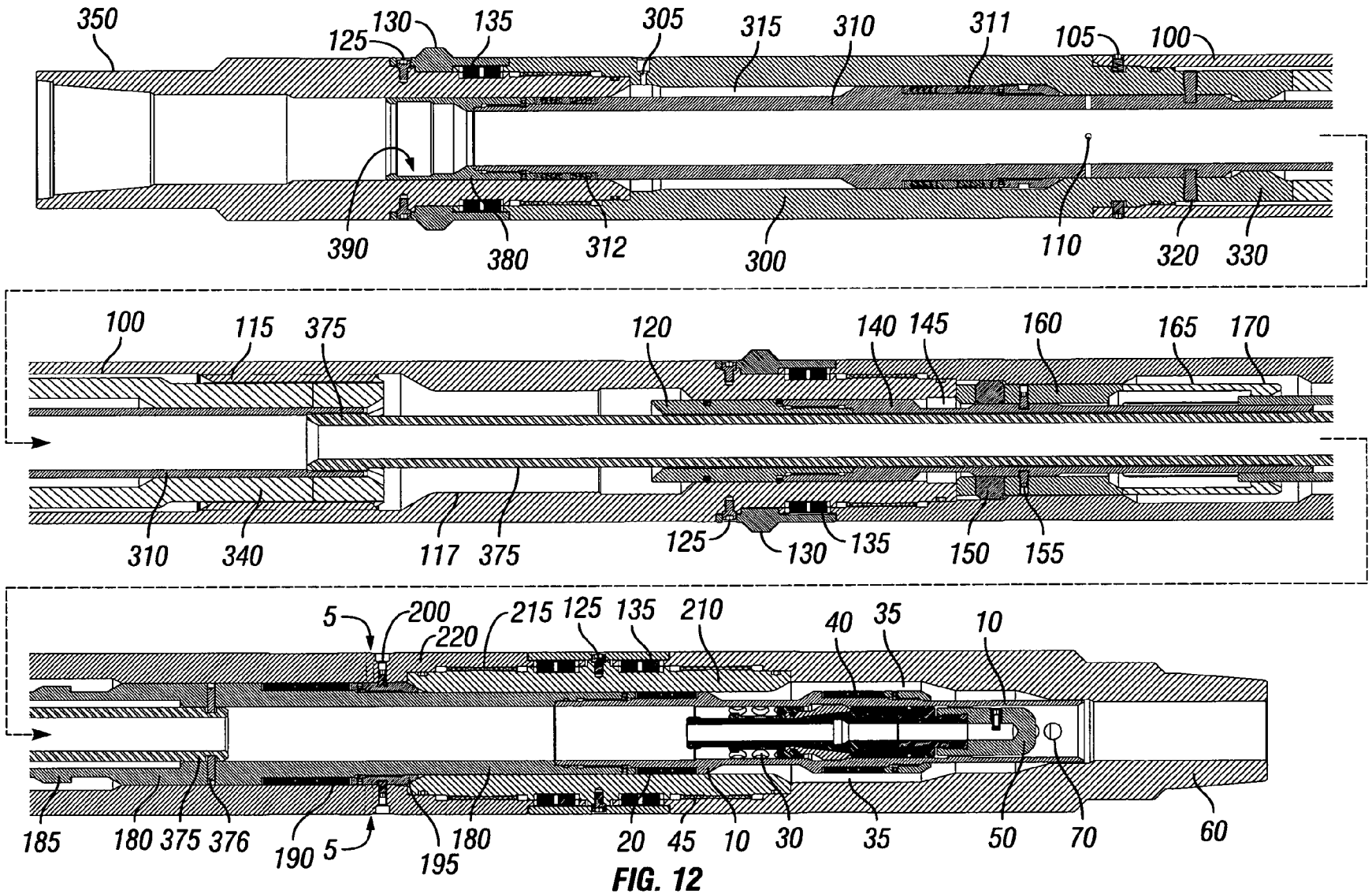
FIG. 12 shows a cross-section view of one embodiment of storm valve that includes a mechanical linkage that may be used to move the valve mechanism of the storm valve to the closed position.
Figure 13:
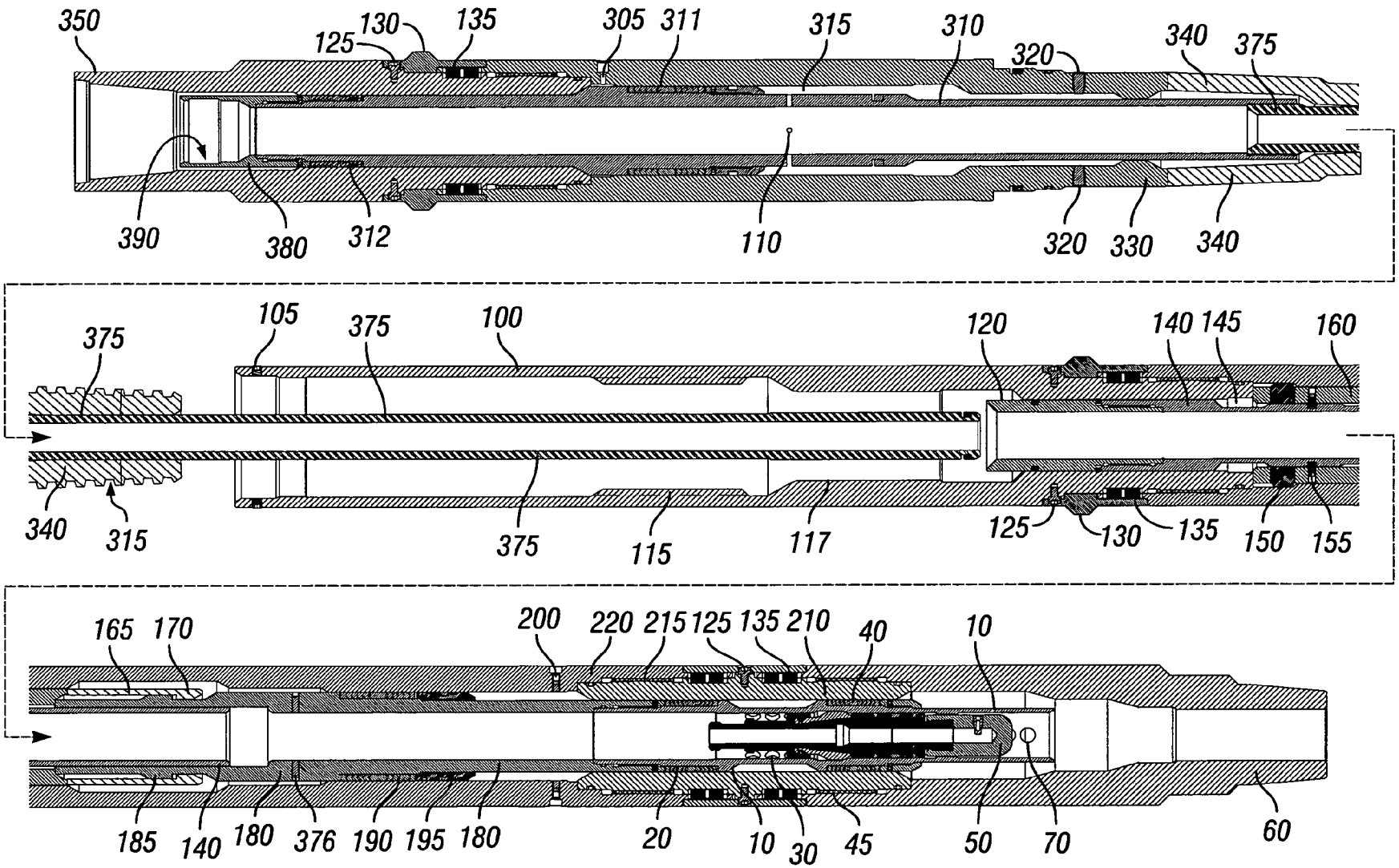
FIG. 13 shows the cross-section view of the embodiment of FIG. 12 disconnecting the running tool from the storm valve.

FIG. 12 shows an embodiment of a storm valve that includes a linkage 375 between the support sleeve 310 and the power piston 180. One or more shearable devices 376, such as a set of shear screws, releasably connect the linkage 375 to the power piston 180. The linkage 375 permits the mechanical actuation of the valve mechanism by shifting the power piston 180 and isolation sleeve 10 up the housing 220. As shown in FIG. 12, linkage 375 provides a secondary means for activating the valve mechanism. A shifting tool, such as a wireline shifting tool, may be used to engage the profile 390 in the support sleeve sub 380 to shift the valve mechanism to the upper or closed position. The linkage 375 also provides that the rotation of the running tool 300 out of the receptacle may be used to shift the valve mechanism to the upper or closed position. The rotation of running tool 300 will impart rotational movement to linkage 375 via the threaded connection between sleeve 310 and the upper end of linkage 375. Shearable devices 376 may extend into an annular recess on the lower end of linkage 375, which permits relative rotation between linkage 375 and piston 180. As the running tool is rotated out of engagement with threaded section 115, linkage 375 moves piston 180 and isolation sleeve 10 upwardly, closing the valve mechanism. In an alternative embodiment, linkage 375 may serve as the primary means for activating the valve mechanism. A power piston may be omitted in this embodiment. If the power piston is omitted, packing means 190, ports 5 and shearable devices 200 may be omitted from item 180 in FIG. 12. In this embodiment, item 180 would serve as an extension from sleeve 10. One of skill will appreciate that the extension in this embodiment could be a separate piece or an integral part of sleeve 10. FIG. 13 shows the linkage 375 of the running tool 300 disconnected from the storm valve.

Figure 14:
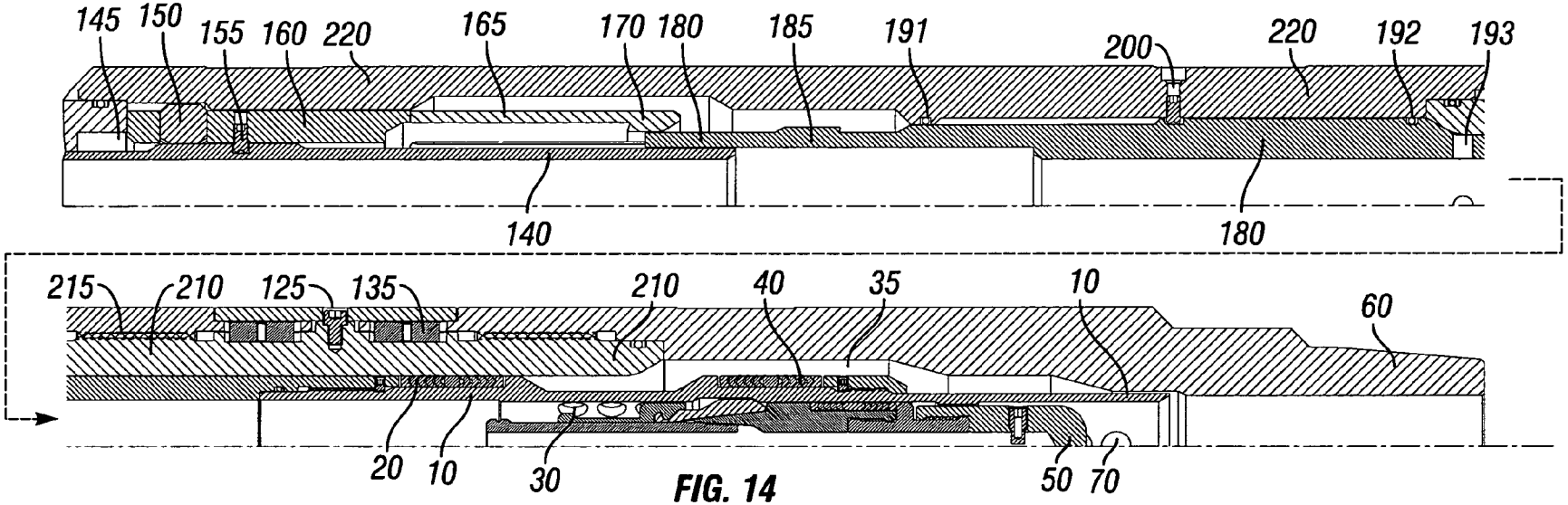
FIG. 14 shows an upper half cross-section view of one embodiment of a storm valve in the running in position in which tubing pressure may be used to close the valve mechanism of the storm valve.
Figure 15:
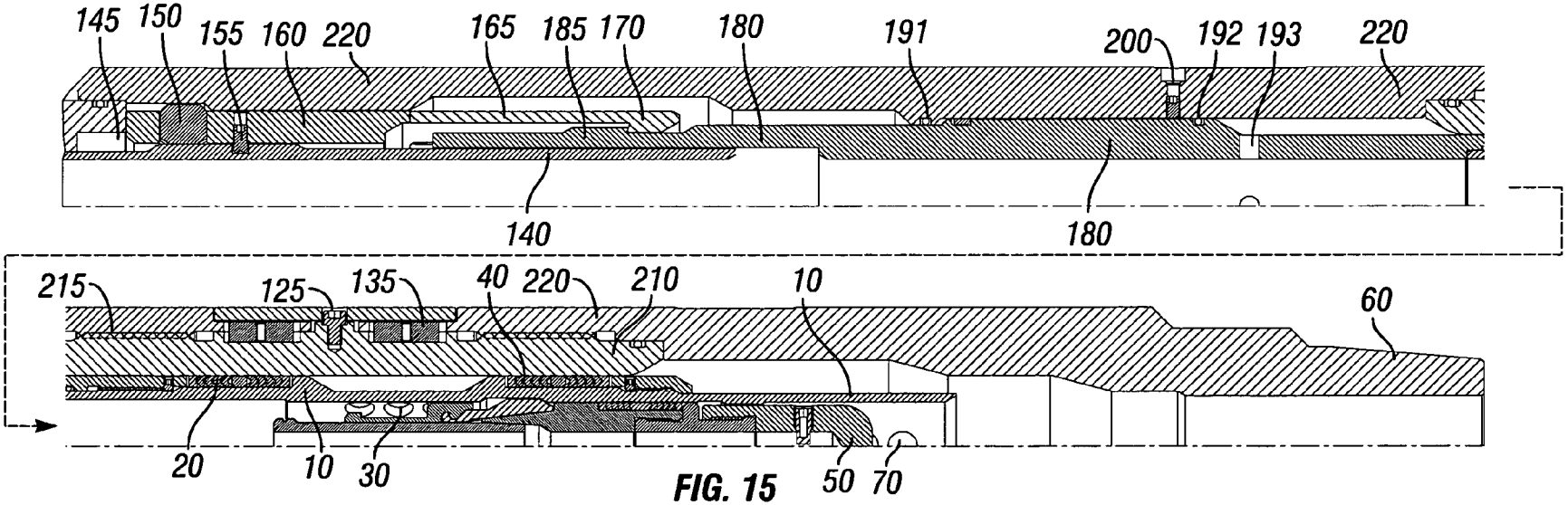
FIG. 15 shows the cross-section view of the embodiment of FIG. 14 in which the valve mechanism of the storm valve is closed.
Figure 16:
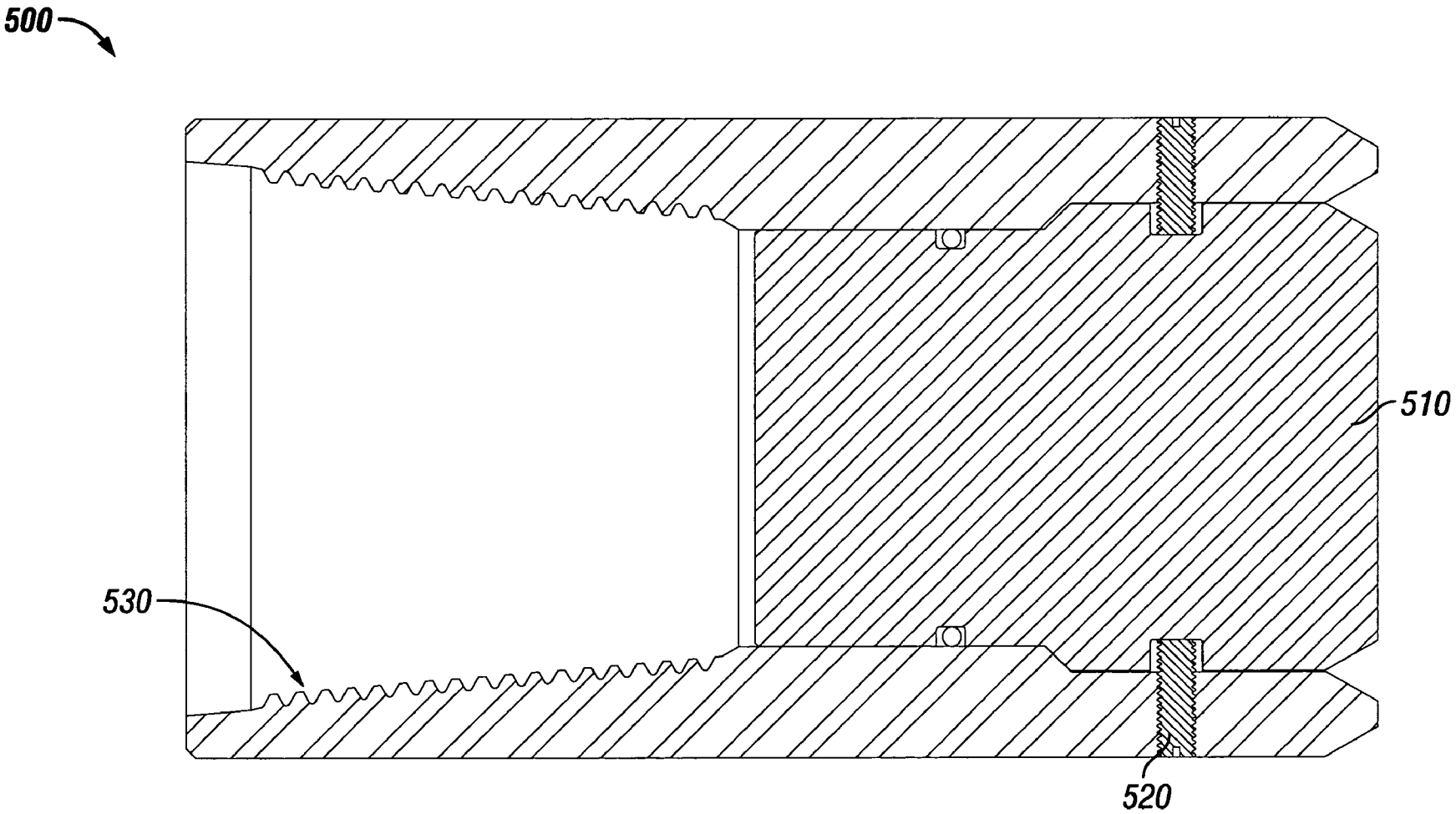
FIG. 16 shows a cross-section view of one embodiment of a device that may be used to plug the tail pipe to allow tubing pressure to close the valve mechanism of the storm valve of FIG. 14.

FIGS. 14 and 15 show one embodiment of a storm valve that may have the valve mechanism actuated by tubing pressure. A plug needs to be inserted into the tail string to permit an increase in tubing pressure. Alternatively, once the packer is set, and there are no open perforation below the packer, the workstring can be pressured without the presence of a plug. FIG. 16 illustrates one embodiment of a plug 500 that may be used to block fluid flow down the tail string. The plug 500 includes a threaded section 530 and a sealing element 510 selectively connected to the housing of the plug 500. A shearable device 520 connects the sealing element 510 to the housing and is adapted to shear at a pressure that is greater than the amount of pressure required to actuate the valve mechanism of the storm valve.

The power piston seals 191, 192 are adapted to permit tubing pressure to move the power piston 180 up the housing 220 moving the isolation sleeve 10 to the upper or closed position. The power piston 180 includes a port 193 through the piston to permit the tubing pressure to produce an upwards force on the power piston seals 191, 192 with respect to the upper seals 20 of the isolation sleeve. FIG. 15 shows the valve mechanism of the storm valve in the upper or closed position. Once it is no longer necessary to isolate the well, tubing pressure may be increased until the shearable elements 520 in the plug 500 deform or shear releasing the sealing element 510.

Figure 18:
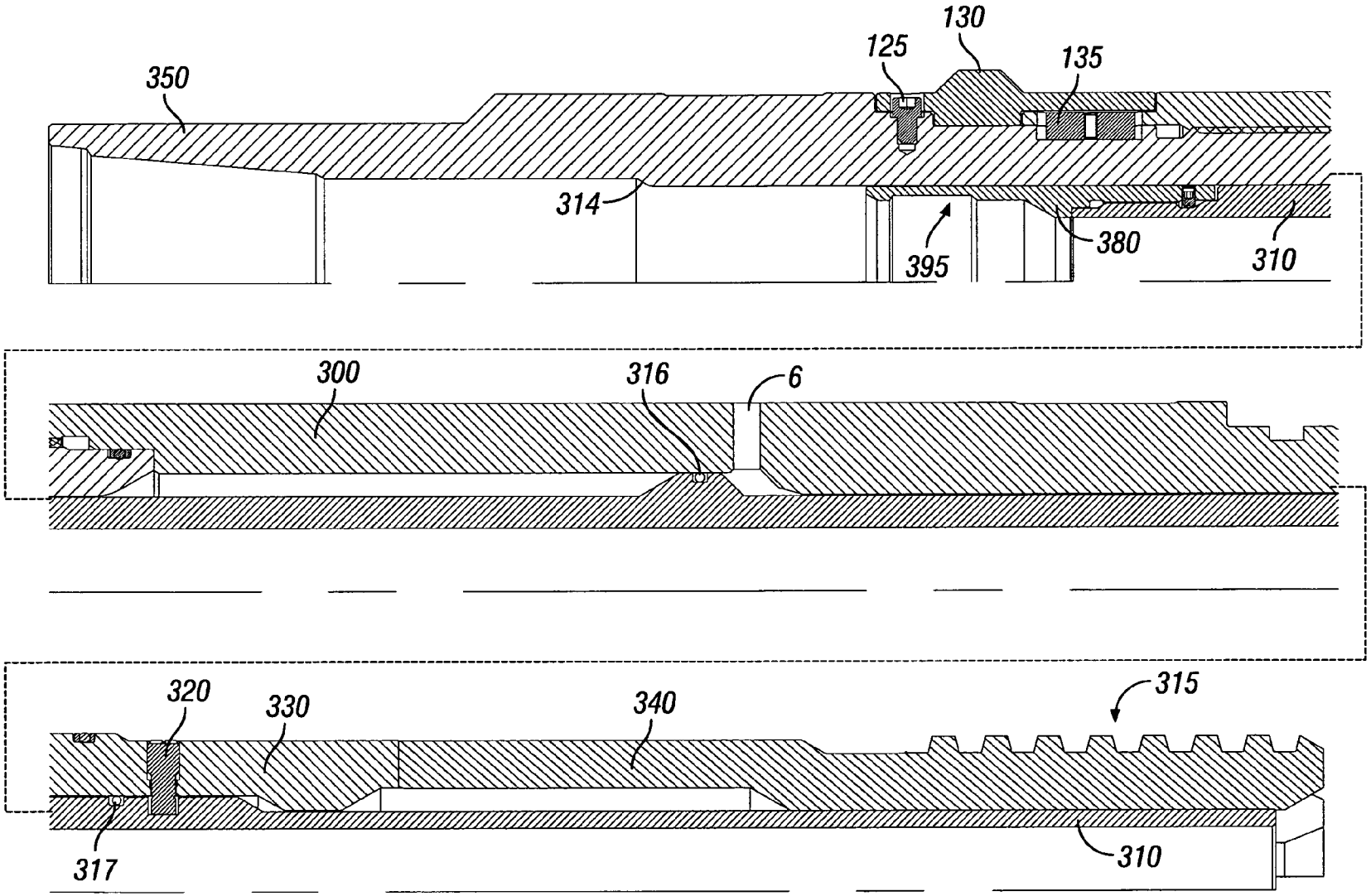
FIG. 18 shows an upper half cross-section view of one embodiment of a running tool that may be disconnected from a storm valve with annular pressure.
Figure 19:
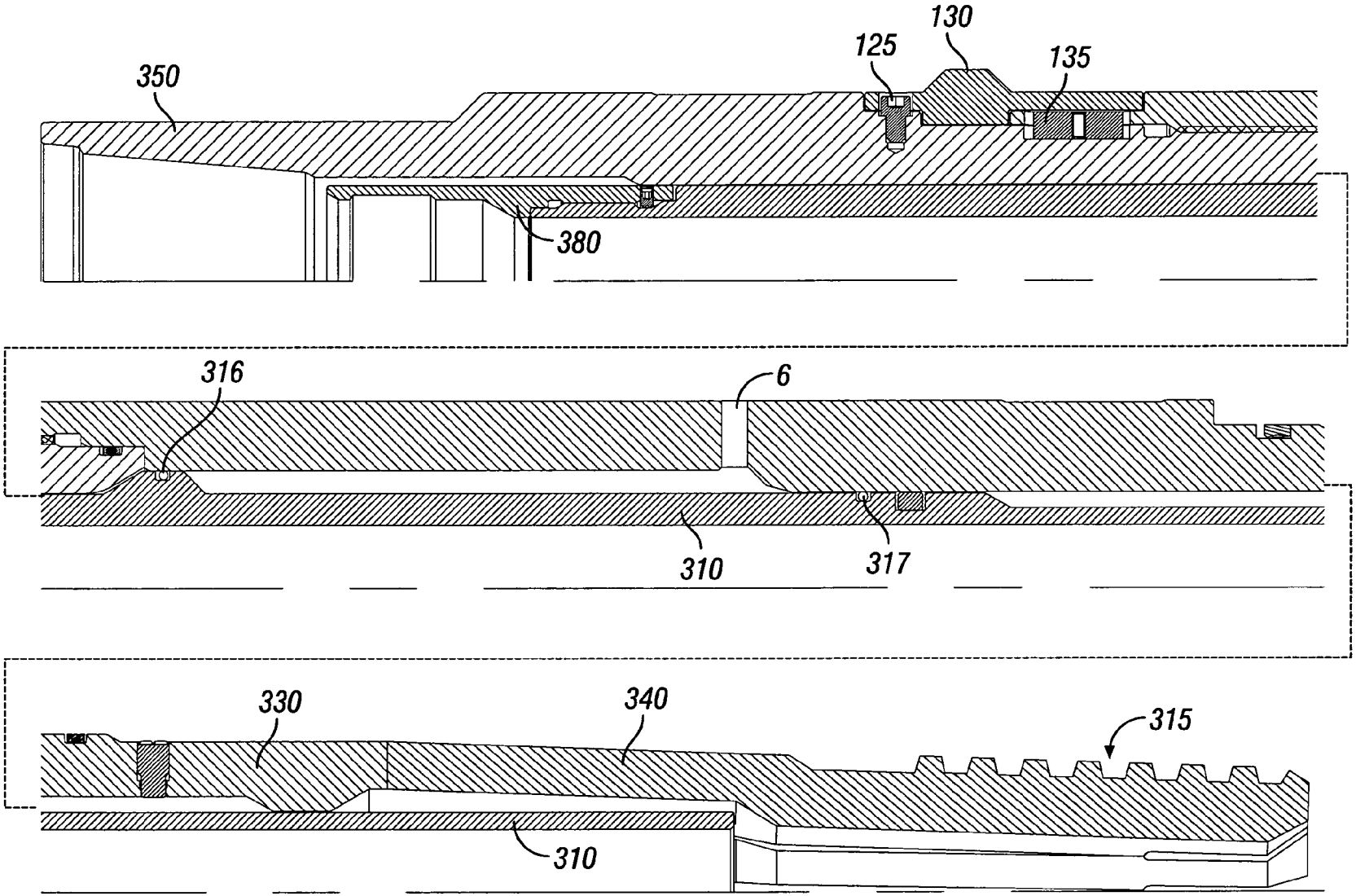
FIG. 19 shows an upper half cross-section view of the running tool of FIG. 18 with the support sleeve moved to its upper position.

FIGS. 18 and 19 illustrate one embodiment of a running tool 300 that may be disconnected from the storm valve by annular pressure. The seals 316, 317 of the running tool 300 are adapted to create an upwards force on the support sleeve 310 upon application of annular pressure to the seals 316, 317 through port 6 in the running tool 300. The upwards movement of the support sleeve 310 releases the running tool 300 from the receptacle 100 of the storm valve as described above.

Although various embodiments have been shown and described, the invention is not so limited and will be understood to include all such modifications and variations as would be apparent to one skilled in the art. By way of example, the closing of the valve mechanism and/or release of the running tool could be accomplished hydrostatically. However, one of skill will appreciate that hydrostatic actuation is simply one form of hydraulic actuation, and thus, is subsumed within hydraulic actuation of the invention as used herein.

What is claimed is:

1. A storm plug for an oil and gas well comprising:

a packer; and a storm valve, the storm valve comprising (i) a valve housing having an upper end and a lower end, the lower end in mechanical communication with the packer, (ii) an isolation sleeve positioned inside of the valve housing, and (iii) a standing valve positioned within the isolation sleeve, wherein the isolation sleeve is hydraulically shiftable between an opened position whereby fluid can flow through an annular bypass area between the valve housing and isolation sleeve, and a closed position whereby the isolation sleeve and standing valve combine to prevent a fluid flow through the storm valve.

2. The storm plug of claim 1, further comprising a power piston connected to the isolation sleeve, the power piston responsive to a preselected hydraulic pressure to shift the isolation sleeve from the opened position to the closed position.

3. The storm plug of claim 1 further comprising a locking mechanism for locking the isolation sleeve in the closed position.

4. The storm plug of claim 1 wherein the upper end of the valve housing is adapted to be releasably connected to a running tool attached to the lower end of a workstring, the running tool being releasable from the valve housing by a preselected hydraulic pressure.

5. A storm plug for an oil and gas well, the storm plug comprising:

a packer; and a storm valve having an isolation sleeve and valve mechanism positioned within the isolation sleeve, wherein the isolation sleeve is hydraulically moveable between a first position permitting fluid flow through the valve mechanism and a second position preventing fluid flow through the valve mechanism.

6. The storm plug of claim 5 further comprising a tail string connected to the packer and a plug in the tail string, wherein tubing hydraulic pressure moves the isolation sleeve from the first position to the second position.

7. The storm plug of claim 6 wherein the running tool may be selectively released from the storm valve by either movement of the running tool or by the application of hydraulic pressure.

8. The storm plug of claim 5 further comprising a linkage, wherein the linkage is connected to a running tool on one end and in mechanical communication with the valve mechanism on an opposite end, the running tool releasably connected to the storm valve.

9. The storm plug of claim 8 wherein non-rotational movement of the linkage can also move the isolation sleeve from the first position to the second position.

10. The storm plug of claim 8 wherein rotation movement of the running tool can also move the isolation sleeve from the first position to the second position.

11. The storm plug of claim 5 further comprising a running tool releasably connected to the storm valve.

12. The storm plug of claim 11 wherein the application of annular pressure releases the running tool from the storm valve.

13. The storm plug of claim 11 wherein the application of tubing pressure releases the running tool from the storm valve.

14. The storm plug of claim 11 wherein rotational movement of the running tool releases the running tool from the storm valve.

15. The storm plug of claim 11 wherein non-rotational movement of the running tool releases the running tool from the storm valve.

16. A storm plug as defined in claim 5, wherein annular hydraulic pressure moves the isolation sleeve from the first position to the second position.

17. A method of temporarily isolating an oil and gas well comprising the steps of:

running a retrievable packer and a storm valve into the well, the storm valve comprising (i) a valve housing having a lower end in mechanical communication with the retrievable service packer, (ii) an isolation sleeve positioned inside of the valve housing and hydraulically shiftable between an opened position and a closed position, and (iii) a standing valve positioned within the isolation sleeve;

setting the retrievable packer; and applying a preselected hydraulic pressure to the valve housing to move the isolation sleeve to the closed position to prevent fluid flow through the storm valve.

18. The method of claim 17 further comprising locking the isolation sleeve in the closed position.

19. The method of claim 18 wherein a running tool is in releasable mechanical communication with the upper end of the valve housing and further comprising applying a second preselected hydraulic pressure to release the running tool from the valve housing.

20. The method of 19 further comprising moving the isolation sleeve back to the opened position and retrieving the retrievable packer and the storm valve from the oil and gas well with a retrieval tool.

21. A method of isolating an oil and gas well, the method comprising the steps of:

(a) running a storm valve into the well, the storm valve comprising a valve housing; and (b) applying a preselected hydraulic pressure to the valve housing to move an isolation sleeve to a closed position to prevent fluid flow through the storm valve.

22. A method as defined in claim 21, wherein step (b) is accomplished by applying the hydraulic pressure via an annulus located between the storm valve and a well casing.

* * * * *